US007669570B2

(12) United States Patent
Hubl et al.

(10) Patent No.: US 7,669,570 B2
(45) **Date of Patent: *Mar. 2, 2010**

(54) DIESEL FUEL INJECTION PRIMING SYSTEM

(75) Inventors: Peter Hubl, Clarkston, MI (US); Henry W Harper, Milford, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/235,979

(22) Filed: Sep. 23, 2008

(65) Prior Publication Data

US 2009/0084334 A1 Apr. 2, 2009

Related U.S. Application Data

(60) Provisional application No. 60/975,983, filed on Sep. 28, 2007.

(51) Int. Cl.
*F02N 17/00* (2006.01)
*F02M 37/00* (2006.01)

(52) U.S. Cl. ..... 123/179.9; 123/514

(58) Field of Classification Search ..... 123/179.9, 123/447, 461, 514

See application file for complete search history.

(56) References Cited

U.S. PATENT DOCUMENTS

| | | | | |
|---|---|---|---|---|
| 4,274,380 | A * | 6/1981 | de Vulpillieres | 123/456 |
| 4,440,138 | A * | 4/1984 | Smith | 123/557 |
| 5,207,203 | A * | 5/1993 | Wagner et al. | 123/514 |
| 6,823,846 | B2 * | 11/2004 | Mattes | 123/456 |
| 6,923,159 | B2 * | 8/2005 | Sakumoto et al. | 123/446 |
| 7,568,471 | B2 * | 8/2009 | Harper et al. | 123/514 |
| 2006/0169252 | A1 * | 8/2006 | Ludwig et al. | 123/447 |
| 2007/0283930 | A1 * | 12/2007 | Jung et al. | 123/447 |

* cited by examiner

*Primary Examiner*—Stephen K Cronin
*Assistant Examiner*—David Hamaoui
(74) *Attorney, Agent, or Firm*—Harness, Dickey & Pierce, P.L.C.

(57) ABSTRACT

A fuel injection priming system includes a fuel supply line connected to a fuel supply rail. A plurality of piezoelectric fuel injectors are connected to the fuel supply rail. An injector return fuel line is connected to the fuel injectors and in communication with a fuel supply line via a diverter device to allow high pressure fuel from the fuel supply line to pressurize the injector return fuel line to backfill the injectors during a priming operation. A one-way valve is in communication with the diverter device to manage the pressurized fuel provided to the plurality of fuel injectors during the priming operation and to allow fuel to pass to the fuel tank during normal operation.

15 Claims, 2 Drawing Sheets

DIESEL FUEL INJECTION PRIMING SYSTEM

CROSS-REFERENCE TO RELATED APPLICATIONS

This application claims the benefit of U.S. Provisional Application No. 60/975,983, filed on Sep. 28, 2007. The disclosure of the above application is incorporated herein by reference.

FIELD

The present disclosure relates to fuel injection systems and more particularly, a diesel fuel injection priming system.

BACKGROUND

The statements in this section merely provide background information related to the present disclosure and may not constitute prior art.

Diesel engines commonly employ a piezoelectric fuel injection system for injecting fuel into the engine. When the diesel engine piezoelectric fuel injection system runs out of fuel, vapor can be trapped in the fuel injectors. This vapor can prevent the engine from re-starting after normal priming of the fuel system with fuel. The injectors may not work properly when filled with an un-pressurized vapor/fuel mixture.

SUMMARY

A fuel injection priming system includes a fuel supply line connected to a fuel supply rail. A plurality of piezoelectric fuel injectors are connected to the fuel supply rail. A return fuel line is connected to the fuel rail and in communication with the fuel supply line via a one-way valve to allow high pressure fuel from the fuel supply line to pressurize the return fuel line.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 1:
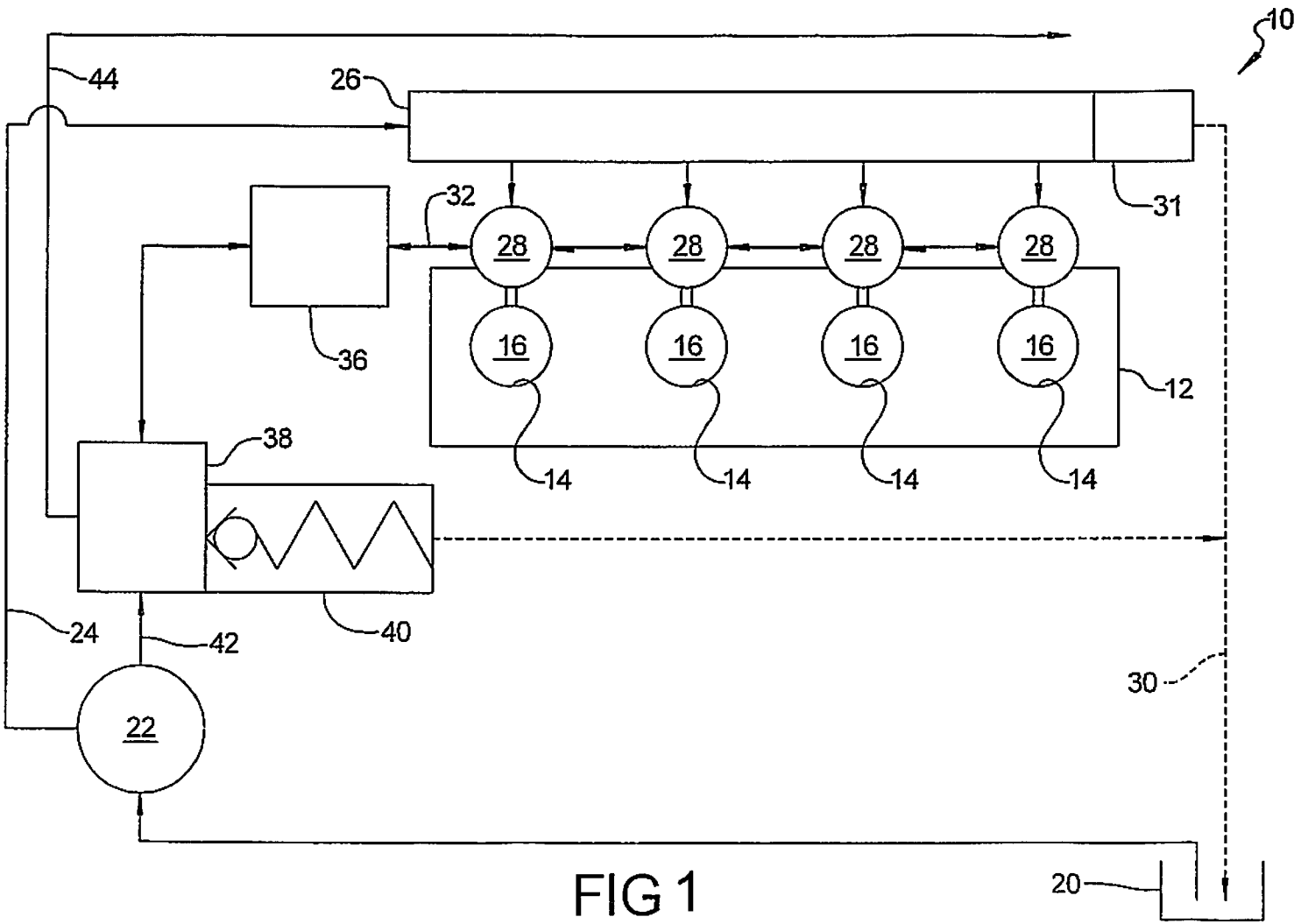
Figure 2:
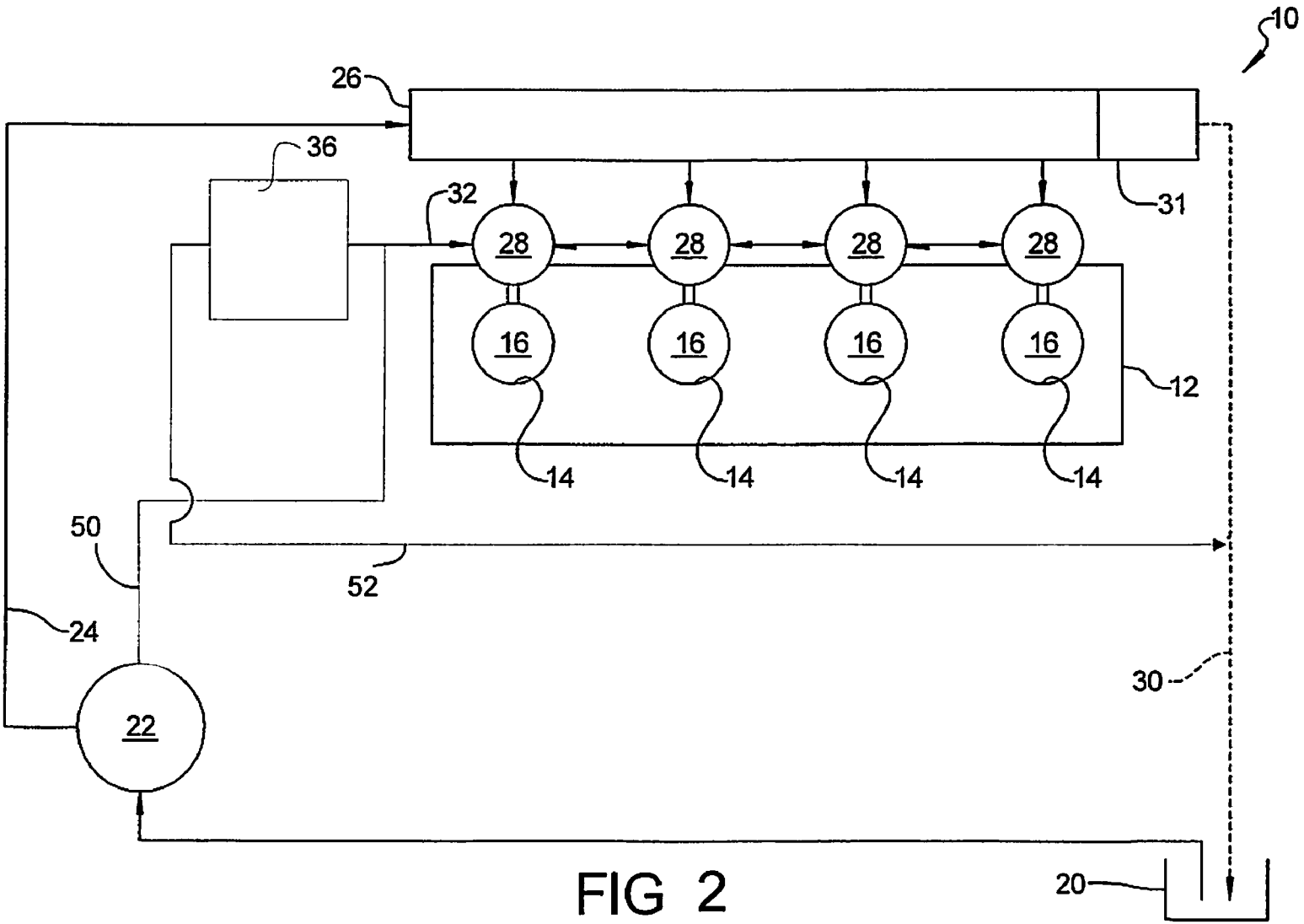

FIG. 1 shows a schematic view of a diesel engine system having a fuel injection priming system according to the present disclosure; and FIG. 2 shows a schematic view of a diesel engine system having an alternative fuel injection priming system according to the present disclosure.

DETAILED DESCRIPTION

The following description is merely exemplary in nature and is not intended to limit the present disclosure, application, or uses.

With reference to FIG. 1, the diesel engine system 10 having a fuel injection priming system, according to the principles of the present disclosure, will now be described. The engine system 10 includes an engine 12 having an engine block defining a plurality of cylinders 14 and a plurality of pistons 16 disposed in respective ones of said plurality of cylinders 14.

A fuel supply system is provided for supplying fuel to each of the cylinders 14 of the engine 12. The fuel supply system includes a fuel tank 20 in communication with a fuel pump 22 that supplies fuel through a fuel supply line 24 to a fuel rail 26. The fuel rail 26 is connected to a plurality of fuel injectors 28 each corresponding with a respective one of the plurality of cylinders 14. A return fuel line 30 is in communication with a pressure control valve 31 connected to the fuel rail 26 and is in communication with the fuel tank 20. An injector return fuel line 32 is connected to the injectors 28. A two-way pressure regulating valve 36 is provided that regulates/maintains the pressure in the fuel return line 32 to a predetermined value. The pressure regulating valve 36 is in communication with diverter device 38 and the fuel supply line 42. The diverter device can optionally be in communication with hydrocarbon injector (HCI) fuel line 44 which is connected to a hydrocarbon-injector (not shown) for after exhaust treatment which is used for exhaust gas treatment for heating of the catalyst during warm-up. The use of hydrocarbon injector fuel line 44 is known in the art and is not part of the current disclosure. The diverter device 38 can be a passive device in that it connects the fuel supply line to pressure regulating valve 36, HCI fuel line 44, and a one way valve 40 in the manner of a four way splitter. Alternatively, the function of one or more of the pressure regulating valve 36, the hydrocarbon injector and the one way valve 40, can be incorporated into an electronically controlled valve-type diverter device for selective control thereof.

The fuel supply line 42 supplies fuel from the fuel pump 22 to the injector return fuel line 32 via the diverter device 38. As discussed above, the diverter device 38 can be an electrically controlled valve or a passive connection that can divert fuel from fuel supply line 42 to backfill the injectors during a priming operation and is normally utilized to provide fuel to the hydrocarbon injector fuel line 44 for after exhaust treatment. A one-way valve 40 is provided in communication with diverter device 38 to divert excessive amounts of pressurized fuel to the tank 20 via the fuel return line 30.

As an alternative, as illustrated in FIG. 2, a passage 50 can be connected directly between the fuel pump 22 and the injector return fuel line 32 so that the injector return fuel line 32 can be pressurized during a priming operation. In this embodiment, the diverter 38 and one way valve 40 can be eliminated. The pressure regulating valve 36 is in communication with the sump 20 via a passage 52.

The fuel injectors 28 may include, but are not limited to, piezoelectric fuel injectors. When the diesel engine piezoelectric fuel injection system has run out of fuel, vapor can become trapped in the fuel injectors 28. This vapor prevents the engine from re-starting after normal priming of the fuel system with fuel. The injectors may not work properly when filled with an un-pressurized vapor/fuel mixture. By pressurizing the return fuel line 32 via the diverter device 38 and pressure regulating valve 36, or alternatively, via passage 50, adequate priming of the fuel injectors 28 is provided to enable engine re-start. The priming system provides adequate return fuel pressure to allow the piezoelectric injector to function as needed for engine re-start by allowing the pressure supplied to backfill the injector return fuel lines, to enable engine re-start.

What is claimed is:

1. A fuel injection priming system for an engine, comprising:

a fuel tank;

a fuel pump in fluid communication with the fuel tank;

a fuel supply rail;

a first fuel line connected to the fuel pump and the fuel supply rail;

a plurality of fuel injectors connected to the fuel supply rail;

a second fuel line extending between the fuel pump and the plurality of fuel injectors, the second fuel line connected to the plurality of fuel injectors and in fluid communication with a pressurized fuel supply via a diverter device in fluid communication with the fuel pump and the second fuel line which allows fuel from the fuel pump to pressurize the fuel injectors via the second fuel line during a priming operation, the fuel rail and the second fuel line forming parallel flow paths between the fuel pump and the plurality of fuel injectors; and a one-way valve in fluid communication with the diverter device to manage the pressurized fuel provided to the plurality of fuel injectors during the priming operation and to allow fuel to pass to the fuel tank during normal operation;

wherein the fuel pump forms an injector supply pump providing pressurized fuel to the fuel injectors at an injector supply pressure.

2. The fuel injection priming system according to claim 1, further comprising a pressure regulating valve in fluid communication with and located between the fuel injectors and the diverter device for maintaining a fuel pressure supplied to the second fuel line.

3. An engine system, comprising:

an engine block defining a plurality of cylinders;

a plurality of pistons disposed in respective ones of the plurality of cylinders;

a fuel tank;

a fuel pump in fluid communication with the fuel tank;

a fuel supply rail;

a first fuel line connected to the fuel pump and the fuel supply rail;

a plurality of fuel injectors connected to the fuel rail and in communication with a respective one of the plurality of cylinders;

a second fuel line extending between the fuel pump and the plurality of fuel injectors, the second fuel line connected to the plurality of fuel injectors and in fluid communication with the fuel pump via a diverter device in fluid communication with the fuel pump and the second fuel line, the diverter device being which is selectively controllable to provide fluid communication between the fuel pump and the fuel injectors via the second fuel line during a priming operation, the fuel rail and the second fuel line forming parallel flow paths between the fuel pump and the plurality of fuel injectors; and a one-way valve in communication with the diverter device to manage the fuel provided to the plurality of fuel injectors during the priming operation and to allow fuel to pass to the fuel tank during normal operation;

wherein the fuel pump forms an injector supply pump providing pressurized fuel to the fuel injectors at an injector supply pressure.

4. The engine system according to claim 3, further comprising a pressure regulating valve in fluid communication with and between the fuel injectors and the diverter device for maintaining a fuel pressure supplied to the second fuel line.

5. A fuel injection priming system for an engine, comprising:

a fuel tank;

a fuel pump in fluid communication with the fuel tank;

a fuel rail;

a first fuel line connected the fuel pump and the fuel rail;

a plurality of fuel injectors connected to the fuel rail;

a second fuel line extending between the fuel pump and the plurality of fuel injectors, the second fuel line connected to the plurality of fuel injectors and in fluid communication with the fuel pump to pressurize the fuel injectors via the second fuel line during a priming operation, the fuel rail and the second fuel line forming parallel flow paths between the fuel pump and the plurality of fuel injectors;

wherein the fuel pump forms an injector supply pump providing pressurized fuel to the fuel injectors at an injector supply pressure.

6. The fuel injection priming system according to claim 5, further comprising a pressure regulating valve in fluid communication with the second fuel line for maintaining a fuel pressure supplied to the second fuel line.

7. The fuel injection priming system according to claim 1, wherein the first and second fuel lines form parallel fuel flow paths between the fuel pump and the fuel injectors.

8. The fuel injection priming system according to claim 7, wherein the first fuel line is in direct communication with the fuel supply rail and the second fuel line is in direct communication with the fuel injectors.

9. The fuel injection priming system according to claim 1, wherein the one-way valve includes a mechanical check valve.

10. The engine system according to claim 3, wherein the first and second fuel lines form parallel fuel flow paths between the fuel pump and the fuel injectors.

11. The engine system according to claim 10, wherein the first fuel line is in direct communication with the fuel supply rail and the second fuel line is in direct communication with the fuel injectors.

12. The engine system according to claim 3, wherein the one-way valve includes a mechanical check valve.

13. The fuel injection priming system according to claim 5, wherein the first and second fuel lines form parallel fuel flow paths between the fuel pump and the fuel injectors.

14. The fuel injection priming system according to claim 13, wherein the first fuel line is in direct communication with the fuel supply rail and the second fuel line is in direct communication with the fuel injectors.

15. The fuel injection priming system according to claim 5, wherein the one-way valve includes a mechanical check valve.

* * * * *